US006036034A

United States Patent [19]

Battaglia et al.

[11] Patent Number: 6,036,034

[45] Date of Patent: Mar. 14, 2000

[54] MODULAR DISPLAY STAND ASSEMBLY

[75] Inventors: Joseph M. Battaglia, Douglasville; Rafael T. Bustos, Atlanta, both of Ga.

[73] Assignee: L&P Property Management Company, South Gate, Calif.

[21] Appl. No.: 09/240,969

[22] Filed: Jan. 29, 1999

Related U.S. Application Data

[63] Continuation-in-part of application No. 29/091,303, Jul. 27, 1998, and application No. 29/091,292, Jul. 27, 1998.

[51] Int. Cl.[7] ..... A47B 43/00

[52] U.S. Cl. ..... 211/187; 211/189

[58] Field of Search ..... 211/187, 189, 211/190; 312/265.1, 265.4; 108/107, 109, 110, 147.12, 147.13, 147.17; 403/217, 218, 219, 174

[56] References Cited

U.S. PATENT DOCUMENTS

| | | | |
|---|---|---|---|
| Re. 28,293 | 1/1975 | Bustos | 108/107 X |
| D. 238,543 | 1/1976 | Lechner | D7/631 |
| D. 282,325 | 1/1986 | Meier | D6/795 |
| D. 292,764 | 11/1987 | Kester | D6/465 |
| D. 321,101 | 10/1991 | Zucker | D6/479 |
| D. 334,854 | 4/1993 | Pestone | D6/458 |
| D. 373,035 | 8/1996 | Keller et al. | D6/477 |
| 1,140,940 | 5/1915 | Bales | 211/87.01 X |
| 1,952,111 | 3/1934 | Bales | 108/107 |
| 3,181,650 | 5/1965 | Cutter et al. | 182/186.7 |
| 3,398,981 | 8/1968 | Vincens | 403/405.1 |
| 3,498,239 | 3/1970 | Bartlett et al. | 108/110 |
| 3,788,242 | 1/1974 | Hassel et al. | 211/148 X |
| 3,835,354 | 9/1974 | Torres-Pena | 211/182 X |
| 4,433,788 | 2/1984 | Erlam et al. | 211/189 X |
| 4,542,702 | 9/1985 | Johansson | 108/109 |
| 4,934,858 | 6/1990 | Beaulieu | 403/217 X |
| 5,016,765 | 5/1991 | Leonardo | 211/189 |
| 5,042,671 | 8/1991 | Bischoff et al. | 211/189 X |
| 5,207,527 | 5/1993 | Duncan et al. | 182/186.8 X |
| 5,609,402 | 3/1997 | Kemp | 211/94 X |
| 5,727,699 | 3/1998 | Gilcrease | 211/113 |

*Primary Examiner*—Daniel P. Stodola
*Assistant Examiner*—Erica B. Harris
*Attorney, Agent, or Firm*—Wood, Herron & Evans, L.L.P.

[57] ABSTRACT

A display stand assembly comprising a plurality of display stand modules joined together. Each display stand module comprises an upper and lower base having a central portion and a plurality of arms extending outwardly from the central portion. A plurality of vertical posts extend between the end portions of the arms of the upper and lower bases and are connected to the arms of the upper and lower bases with a plurality of hubs. Each hub has a plurality of connectors for receiving the arms of adjacent display stand modules in order to connect the display stand modules to each other. A portion of each hub fits inside one of the vertical posts.

28 Claims, 6 Drawing Sheets

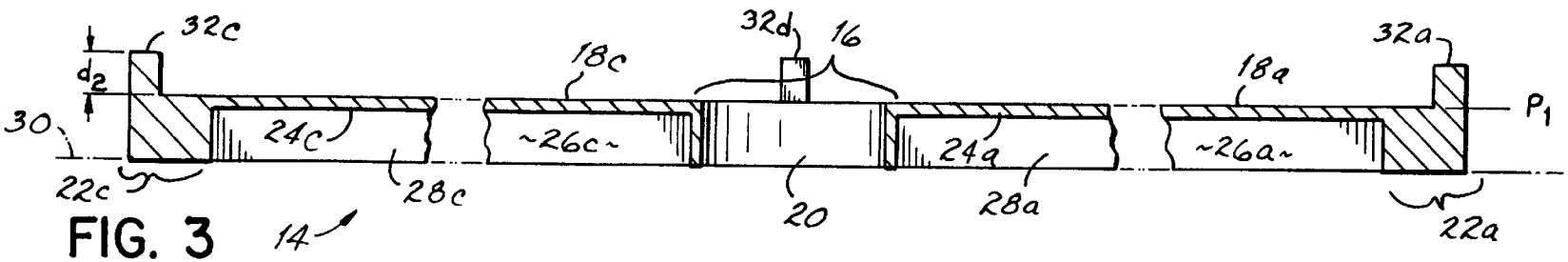
FIG. 3
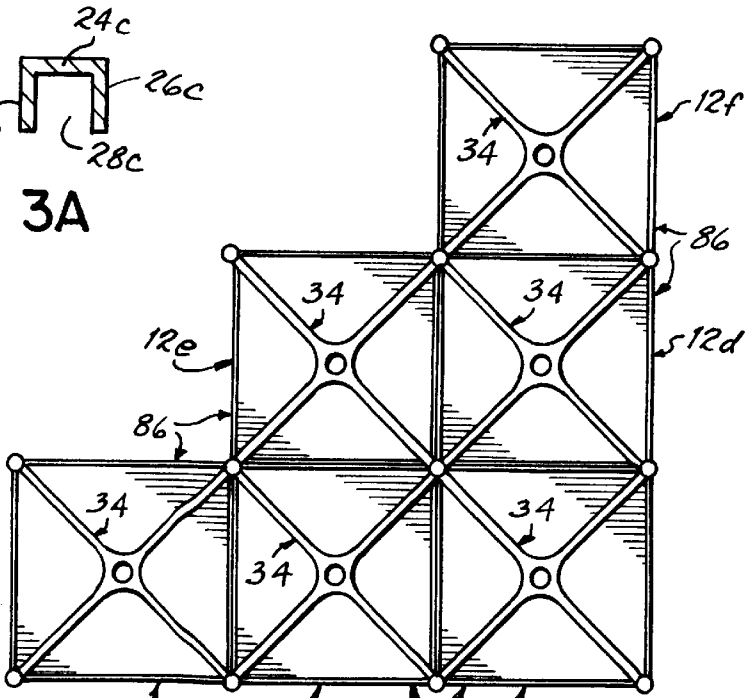
FIG. 3A
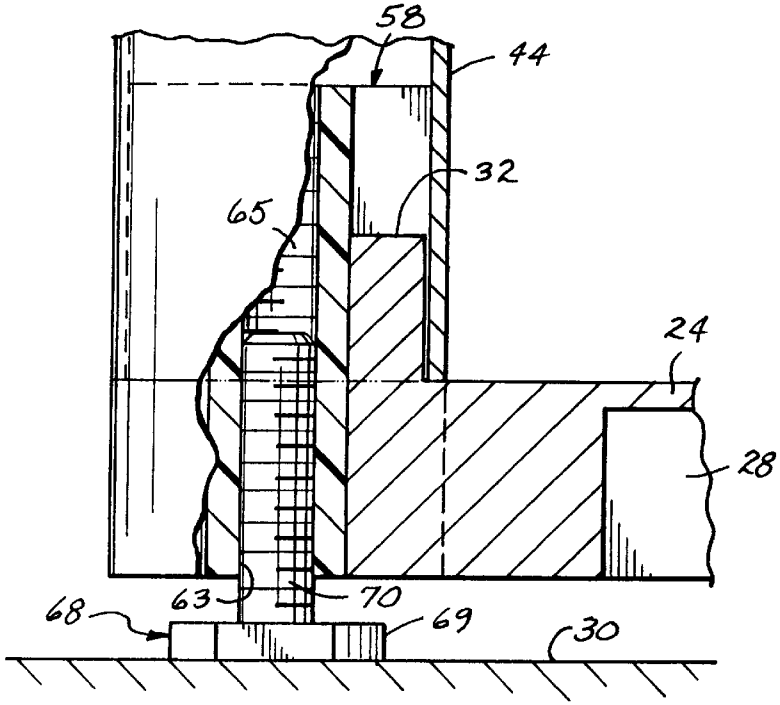
FIG. 9
FIG. 8

MODULAR DISPLAY STAND ASSEMBLY

CROSS REFERENCE TO RELATED APPLICATIONS

This application is a continuation-in-part application of U.S. design patent application Ser. No. 29/091,303 filed Jul. 27, 1998 entitled Modular Display Stand Base and U.S. design patent application Ser. No. 29/091,292 filed Jul. 27, 1998 entitled Modular Display Stand.

FIELD OF THE INVENTION

This invention relates to display stands for merchandising products; and more particularly, to a display stand assembly made by joining together a plurality of display stand modules.

BACKGROUND OF THE INVENTION

Display stands are typically used to store and display product in both refrigerated and non-refrigerated environments. Such display stands usually comprise a base, a plurality of vertical support members or posts extending upwardly from the base, and a top supported by the posts. A plurality of shelves are commonly supported by the vertical posts in any number of ways. Such display stands or shelving units are usually rectangular, and the shelves adapted to be used with the display stands are rectangular as well.

U.S. Pat. Nos. 5,016,765 and 3,788,242 disclose such display stands. In each of the display stands disclosed in these patents, a generally rectangular base has four members extending upwardly from the base, which members are used to support vertically oriented posts. Generally rectangular shelves may be supported by the posts at the desired heights. Similarly, the tops of each of the display stands disclosed in these patents have four members which are turned downwardly and inserted into the posts at the top of the display stand.

Each of the display stands disclosed in these patents is selfstanding and is not adapted to be joined with other display stands in order to create a larger display stand. If more product is to be displayed, a second display stand must be purchased and placed adjacent to the first display stand. The display stands lack structure which would enable multiple display stands to be joined together to create a larger display stand or assembly.

In addition, such display stands are of a fixed width, length and height which cannot be modified or changed. Thus, if a merchant desires to display additional product above or beside the display stand, an additional display stand must be purchased and placed on top of or beside the existing display stand. Thus, the merchant has to pay for two or more display stands. Furthermore, if an additional display stand is placed on top of an existing display stand, the upper display stand may be unstable and may fall off the lower display stand.

Thus, a display stand which is modular in nature so that different modules may be secured to one another to create the desired structure is needed. With such a structure, modules may be placed on top of one another or connected to each other lengthwise or widthwise in order to create the desired display stand assembly.

Therefore it has been one objective of the present invention to provide a display stand module which may be quickly and easily joined to other display stand modules in order to create an attractive and useful display stand assembly.

It has further been an objective of the present invention to provide a display stand module which may be assembled from a limited number of similar components, reducing the cost of manufacturing.

It has been a further objective of the present invention to provide a display stand module which may be joined with other display stand modules in order to create a display stand assembly specifically configured for a unique environment.

Still another objective of the invention has been to create a multiple module display stand which utilizes components of one module as a common component of an adjacent module so that the total number of components in a multiple module display stand is minimized with a corresponding cost reduction.

SUMMARY OF THE INVENTION

The invention of this application which accomplishes these objectives comprises a display stand assembly made up of a plurality of display stand modules joined to one another. Each display stand module comprises a lower base having a central portion and a plurality of arms extending outwardly from the central portion, an upper base having a central portion and a plurality of arms extending outwardly from the central portion, vertical posts extending between outermost end portions of the arms of the upper and lower bases and a plurality of hubs connecting the vertical posts to the outermost end portions of the arms of the upper and lower bases.

The upper and lower bases of each display stand module are preferably identically configured. One preferred embodiment of base has a central portion with a hole therethrough and four arms extending outwardly from the central portion of the base. The arms are generally orthogonal to one another, with two of the arms being collinear. However, upper and lower bases having any number of arms may be utilized in accordance with the present invention. A second preferred and less expensive embodiment of base has a central portion without a hole therethrough and four arms extending outwardly from the central portion of the base.

Each arm of the upper and lower bases terminates in an end portion having at least one finger. The fingers are sized and adapted to releasably engage connectors integrally formed in hubs in order to join the base arms to vertical posts and join multiple arms of multiple bases together. The preferred base of the present invention has only one finger at the end of each arm. However, alternative configuration of bases may have arms which terminate in end portions having any number of fingers in accordance with the present invention. The fingers may be of any desired height or configuration. Additionally, other structures other than fingers may be used to connect the outer end portions of the base arms to the hubs.

Each of the vertical posts of the present invention has a hollow interior, is vertically oriented and extends between the end portions of the arms of the upper and lower bases. Each of the vertical posts is slotted along its length so that shelves may be supported from the vertical posts at desired heights with support means locked into engagement with the slots of the vertical posts. One type of support means used in accordance with the present invention is formed sheet metal clips which are inserted into the slots of the vertical posts and rotated in order to lock the clips at predetermined vertical heights. The shelves are lowered downwardly into engagement with the clips so that a portion of the shelf rests on the clips. The shelves may be adjusted vertically as necessary by moving the clips to the desired height. Other support means may be used in accordance with the present invention. Alternatively, the clips may be omitted such as, for example, if the shelves have tabs which are inserted directly into the slots of the vertical posts.

The hubs of the present invention which connect the vertical posts to the end portions of the arms of the upper and lower bases are all identically configured and each has a first portion and a second portion, the diameter of the first portion being greater than the diameter of the second portion. The diameter of the second portion is approximately equal to the inner diameter of each of the vertical posts. Thus the second portion of each hub is adapted to be received and fit within a hollow interior of a vertical post of the present invention. The diameter of the first portion is greater than the inner diameter of the vertical posts, thus functioning as a stop to position one of the vertical posts on the hub.

One embodiment of hub of the present invention is generally clover-shaped having four quarter sections separated by a plurality of generally rectangular connectors integrally formed therein for receiving the end portions of the arms of adjacent display stand modules. Each connector is specifically sized so as to receive one of the fingers of an end portion of one of the base arms. Although in the preferred embodiment of the present invention each hub has four connectors, the hubs may be configured differently and have any number of connectors such as, for example, three or five.

In order to create one of the display stand modules, a lower base is placed on a supporting surface so that the fingers of the outer end portions of the arms project above the upper surface of the base, i.e., are upwardly turned. Then one of the hubs of the present invention is engaged with each of the arms of the lower base by releasably securing one finger of the outer end portion of the arm in one of the recesses or connectors of the hub. Assuming there are four hubs engaged with four arms of the lower base, all are oriented similarly with the second portions of the hubs being located above the first portions of the hubs.

A first or lower end of a hollow vertical post is then placed over the second portion of each of the hubs engaged with the arms of the lower base, thus supporting the vertical post in a vertical orientation. The lower end of each post slides over the finger or fingers located in the connectors of the hub to lock the arms and hubs to the posts.

An upper base identically configured to the lower base and having a plurality of arms extending outwardly from a central portion is then positioned over the top of the four vertical posts. The upper base is inverted relative to the lower base so that the fingers at the outer ends of the arms of the upper base are downwardly directed, whereas the fingers at the outer ends of the arms of the lower bases are upwardly directed. An upper hub is then engaged with the end portion of each arm of the upper base. The second portion of each of the upper hubs are inserted into the hollow interiors of the vertical posts with the fingers of the arms extending downwardly into the posts to lock the arms of the upper base and the hubs to the posts and thereby complete the assembly of the display stand module.

An alternative method of assembling a display stand module is to secure one of the hubs to each end of each of the vertical posts. A lower base is then placed on a supporting surface, and each arm of the lower base is joined to a hub located at the bottom end of a vertical post, thus orienting the post vertically. The arms of the upper base are then secured to the hubs located at the top of the vertical posts in order to complete the assembly of one module.

In order to support a shelf extending between the vertical posts shelf supporting clips are then removably secured at approximately the same vertical height on each of the four vertical posts of a display stand module. Any number of shelves may be removably secured to the display stand module in this manner. Additionally, because the clips are removably secured in slots of the vertical posts, the vertical distance between shelves may be adjusted according to the product to be displayed on the shelves.

In order to create a display stand assembly, multiple display stand modules may be joined together by joining the end portions of the arms of different bases to common hubs. Because each hub has multiple connectors, each hub may receive and hold multiple end portions of multiple arms of multiple upper or lower bases. For purposes of this application hubs which receive and hold at least two end portions of at least two different arms of at least two different bases will be referred to as common hubs.

In order to join a first and second display stand module to create a display stand assembly, a first lower base of a first display stand module and a second lower base of a second display stand module are placed on a supporting surface. One of the arms of the first lower base and one of the arms of the second lower base are secured to a first common hub. A second arm of the first lower base and a second arm of the second lower base are both secured to a second common hub. At this point the two lower hubs of the first and second modules are joined together. Depending on the number of connectors in each hub, any number of arms of any number of bases may be joined to a common hub. For example, if a common hub has four connectors, up to four arms of up to four bases may be connected to that common hub. Additional hubs are attached to the remaining arms of the lower bases so that each arm of each of the lower bases has a hub secured to the end portion of the arm. These additional hubs have only one of their connectors filled with a finger of an arm of one of the lower bases.

A lower end of a hollow vertical post is placed over a portion of each of the hubs engaged with the lower bases so that each of the hollow vertical posts are vertically oriented. More specifically, the lower ends of the hollow vertical posts fit over the second portions of the hubs, with at least one finger of the end portion of each arm located inside the lower ends of the hollow vertical posts. The vertical posts extending between common hubs will be referred to in this application as common vertical posts.

A first upper base of the first display stand module and a second upper base of the second display stand module are then joined together with common hubs, i.e., one of the arms of the first upper base and one of the arms of the second upper base are connected to a third common hub, and a different arm of the first upper base and a different arm of the second upper base are connected to a fourth common hub. Additional hubs are secured to the remaining arms of the first and second upper bases. The upper bases are aligned in the same orientation as the lower bases so that the third and fourth common hubs are immediately above the first and second common hubs, respectively. Each of the hubs attached to the arms of the upper bases is oriented with the second portions of the hubs located below the first portions of these hubs. The second portions of these hubs are then placed inside the upper ends of the hollow vertical posts in order to complete the assembly.

Another method of assembling a display stand assembly from several display stand modules comprises supporting a pair of lower bases on a supporting surface so the fingers at the outer end portions of the arms of the bases are upwardly directed. One of the hubs is inserted into each end of each of the vertical posts of the display stand assembly to create a post assembly. At least one finger of the outer portion of each arm of each lower base is inserted into one of the connectors of one of the hubs secured to one of the vertical posts, in order to support the vertical post in a vertical orientation and secure the lower bases to the vertical posts. Select hubs have more than one finger inserted into more than one connector of the hub and are considered common hubs. With the vertical posts oriented vertically, the upper bases are oriented so that their fingers are downwardly directed, and they are secured to the upper ends of the vertical posts by inserting the fingers at the outer end portions of the arms of the upper bases into the connectors of the hubs secured to the upper ends of the vertical posts.

Although different methods of joining two display stand modules have been described hereinabove, any number of modules may be joined together in the same manner or a similar manner in accordance with the present invention.

As described hereinabove, clips may be placed in the slots of the vertical posts of each module at preselected vertical heights and shelves supported by the clips, the shelves extending between the vertical posts.

Therefore the present invention allows the creation of numerous different configurations of display stand assemblies with the use of a relatively few number of identical parts. According to the practice of the invention, relatively few parts are needed to assemble a display stand module and join a plurality of display stand modules together to create a display stand assembly. Therefore the number of molds or fixtures necessary to make parts is reduced and if parts are lost or stolen, additional parts can be easily obtained. Additionally, no hardware such as screws, nuts or bolts is needed to assemble a display stand module or the display stand assembly according to the practice of the invention. These and other objects and advantages of the present invention will be apparent from the following description of the drawings.

BRIEF DESCRIPTION OF THE DRAWINGS

FIG. 3 is a cross-sectional view taken along the line 3—3 of FIG. 2.

FIG. 3A is a sectional view taken along the line 3A—3A of FIG. 2.

FIG. 8 is a top plan view of an alternative configuration of display stand assembly made from six modules illustrating the flexibility of the modular system of this invention.

FIG. 9 is a partially broken away cross-sectional view of one of the hubs of the present invention supported upon an adjustable foot.

DETAILED DESCRIPTION OF THE DRAWINGS

Figure 1:
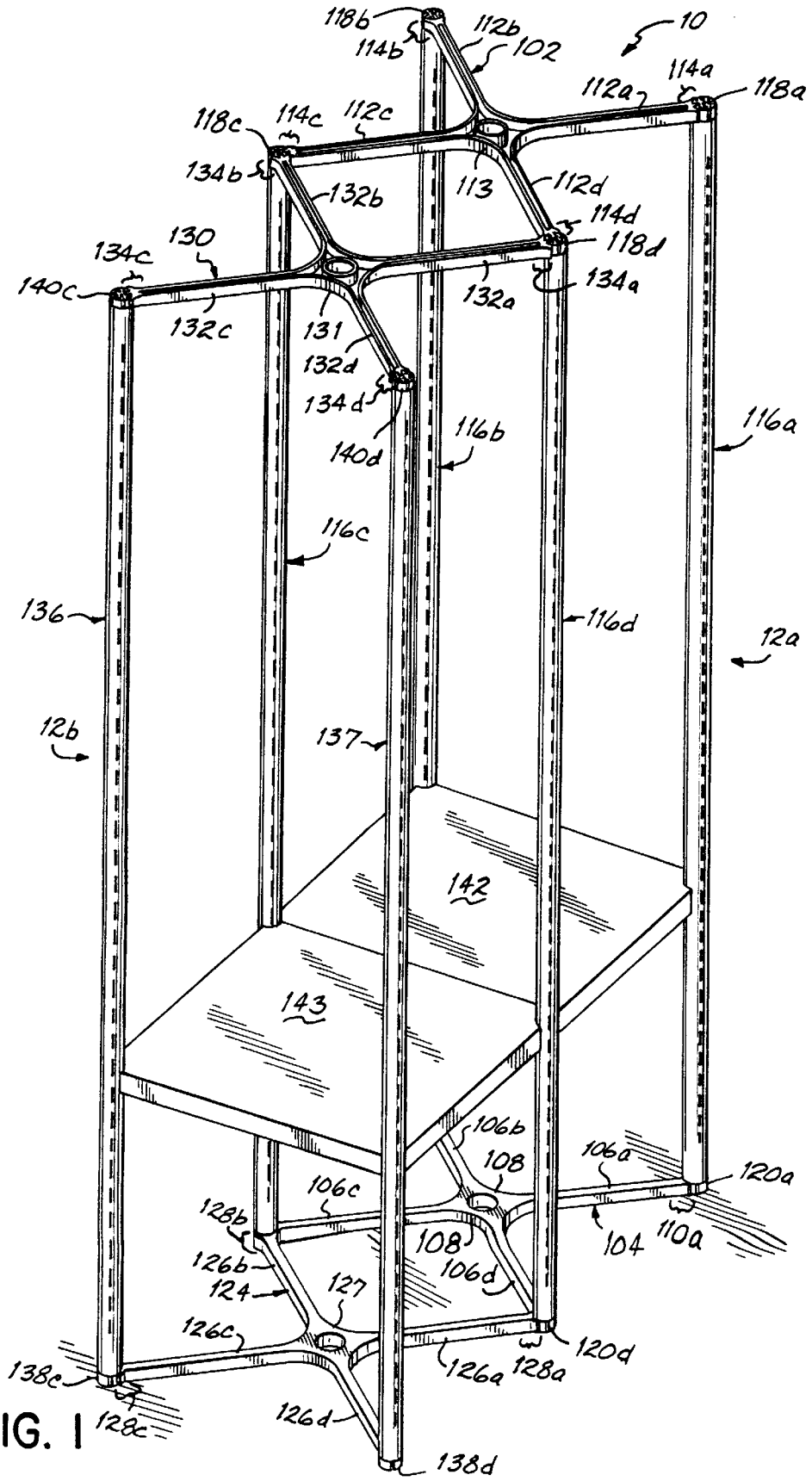
FIG. 1 is a perspective view of a display stand assembly made up of two display stand modules of the present invention.

Referring to the drawings, and particularly to FIG. 1, there is illustrated a display stand assembly 10 made up of two display stand modules 12*a* and 12*b*. Although only two display stand modules are illustrated, any number of display stand modules may be connected together in accordance with the present invention in order to create a display stand assembly. The display stand assembly may have different configurations depending upon the number of modules used to make the assembly, the configuration of the bases of the modules, and upon the orientation of the modules relative to one another. For example, FIG. 8 illustrates a display stand assembly made up of six display stand modules 12*a*–12*f* joined together in a unique configuration.

Figure 2:
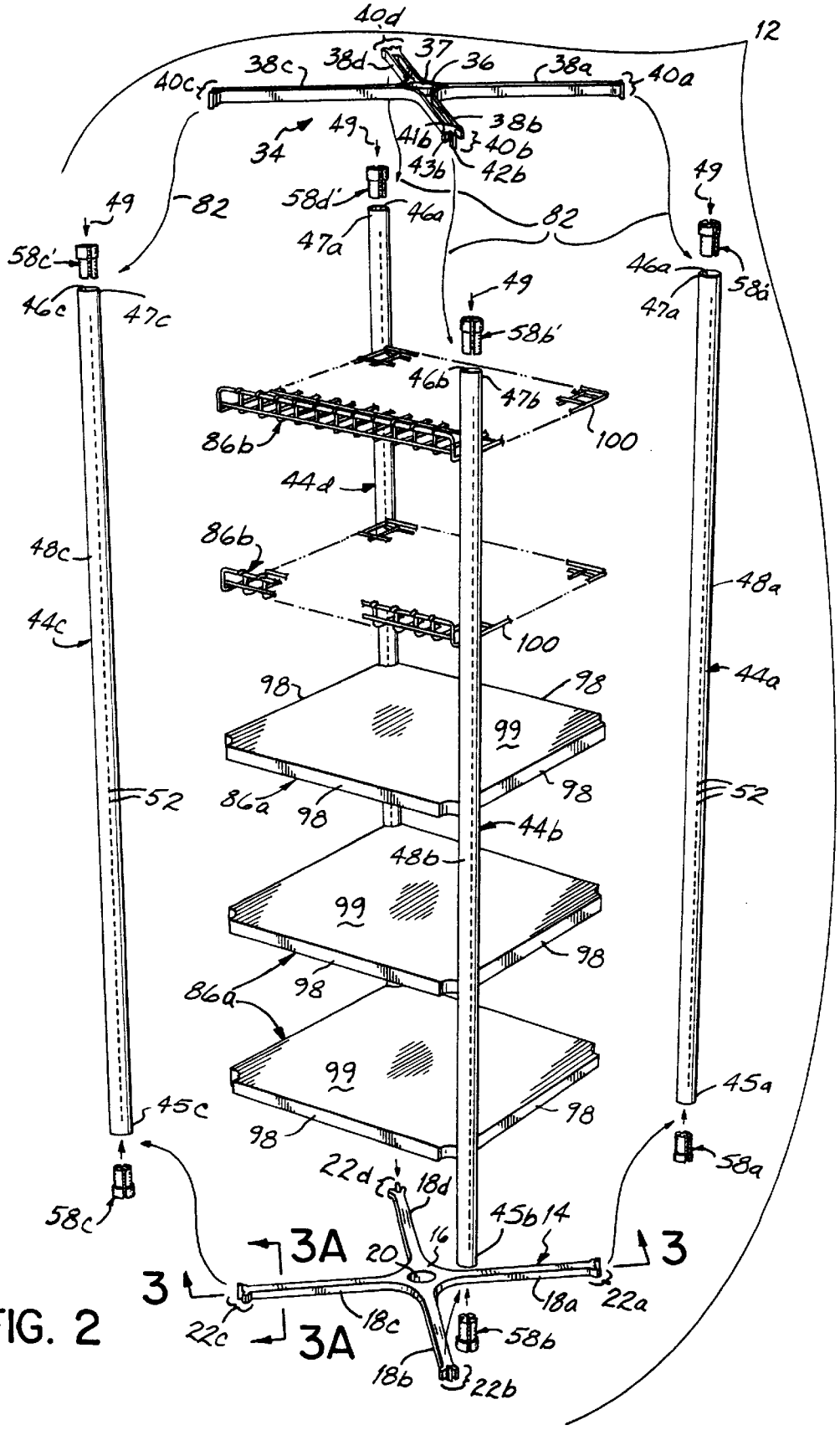
FIG. 2 is an exploded perspective view of one of the display stand modules of FIG. 1.
Figure 4:
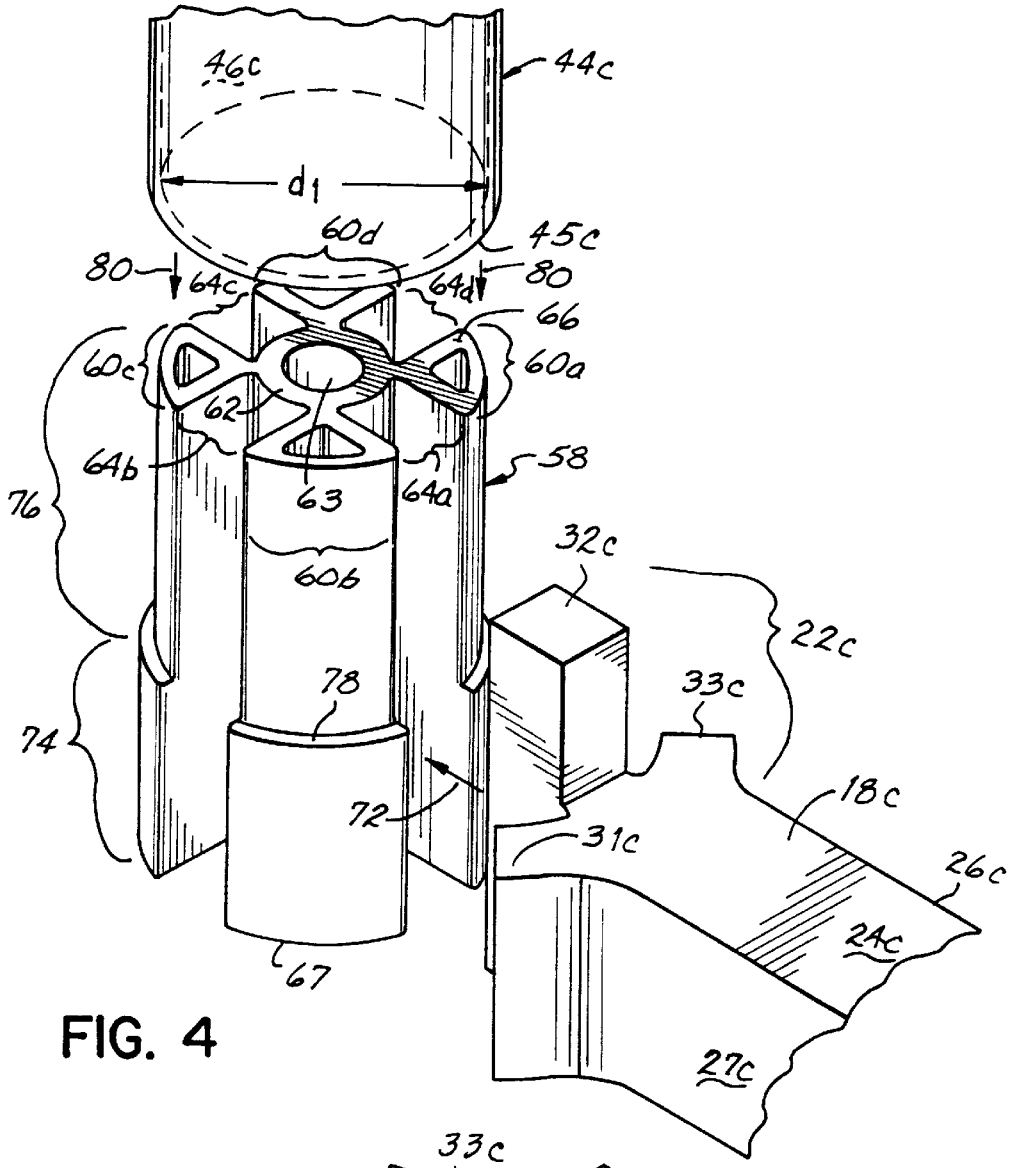
FIG. 4 is an enlarged exploded perspective view of an end portion of one of the arms of one of the bases, one of the hubs and one of the vertical posts before they are assembled together.

Referring to FIG. 2, each display stand module 12 of the present invention comprises a plurality of components interconnected to one another. Each display stand module 12 comprises a lower base 14 having a central portion 16 and a plurality of arms 18*a–d* extending outwardly from the central portion 16 of the lower base. Although the drawings illustrate four arms 18*a*–18*d*, any number of arms may be used in accordance with the present invention. The central portion 16 of the lower base 14 is illustrated as having a hole 20 therethrough. The hole 20 is created by the manufacturing process and may be omitted. Each of the arms 18*a–d* extends outwardly from the central portion 16 and terminates in an end portion 22*a*–22*d*. As best illustrated in FIGS. 3 and 3A, each of the arms 18*a–d* has a top wall 24*a–d* and two side walls 26*a–d* and 27*a–d* extending downwardly from the outer edges of the top wall. The top wall and two side walls define a hollow cavity 28*a–d* with the supporting surface 30 upon which the lower base 14 may rest. As best illustrated in FIGS. 3 and 4, each of the end portions 22*a–d* is solid and has three fingers 31*a–d*, 32*a–d* and 33*a–d*. For purposes of illustration only, FIG. 4 illustrates arm 18*c* of lower base 14. A middle finger 32*c* is located between a pair of outer fingers 31*c* and 33*c*. The middle finger 32*c* is substantially taller than the other two fingers 31*c*,33*c* and extends above the top wall 24*c* of the arm. As best illustrated in FIG. 4, the outer fingers 31*c*,33*c* do not extend above the top wall 24*c* of the arm but rather are the same height as the arm. Each of the arms is configured identically but need not be so.

Referring back to FIG. 2, the display stand module 12 further comprises an upper base 34 having a central portion 36 and a plurality of arms 38*a–d* extending outwardly from the central portion, each arm 38*a–d* terminating in an end portion 40*a–d*. The end portion 40*a–d* of each arm 38*a–d* has three fingers including a middle finger 42*a–d* located between two outer fingers 41*a–d* and 43*a–d* (only middle finger 42*b* and outer fingers 41*b* and 43*b* being labeled or identified). The central portion 36 of the upper base 34 has a hole 37 therein like the lower base 14.

Although the upper and lower bases are configured identically, the upper base 34 is inverted (i.e., upside down) relative to the lower base 14 so that the top wall 24*a–d* of each of the arms 18*a–d* of the lower base 14 becomes a floor of the arms of the upper base and the side walls extend upwardly from the floor. Additionally, the middle fingers 42*a–d* project downwardly from the end portions 40*a–d* of the arms 38*a–d* of the upper base 34, whereas the middle fingers 32*a–d* project upwardly from the end portions 22*a–d* of the arms 18*a–d* of the lower base 14. Both bases may be made from the same mold, thereby reducing the cost of manufacturing the bases. The bases may be plastic, aluminum, steel or any other material and may be molded or fabricated from sheet metal.

Figure 5:
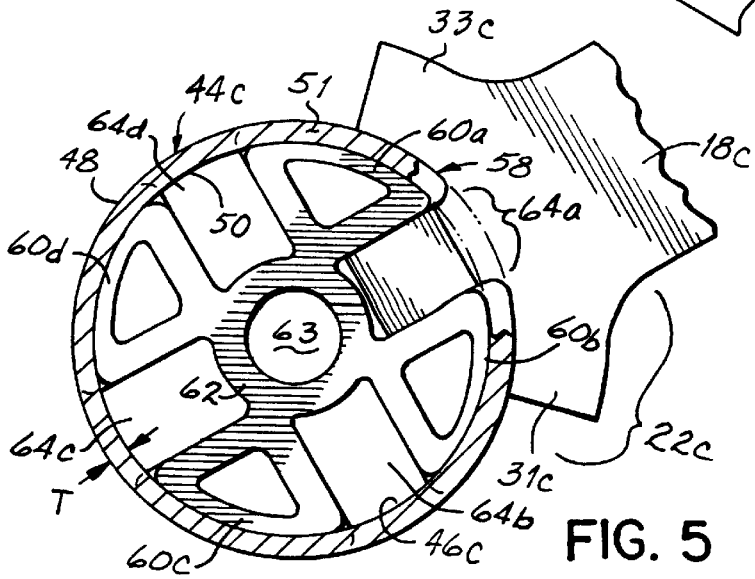
FIG. 5 is a top cross-sectional assembled view of FIG. 4.

Referring to FIG. 2, a plurality of vertical posts 44*a–d* extend between the end portions of the arms of the upper and lower bases. Each of the vertical posts 44*a–d* has a hollow interior and, as best illustrated in FIG. 5, has a cylindrical outer surface 48 and a concentric cylindrical inner surface 50. The distance between the inner and outer surfaces defines the thickness T of the cylindrical wall 51 of the hollow vertical post. Each of the posts 44*a–d* is identically configured.

Figure 6:
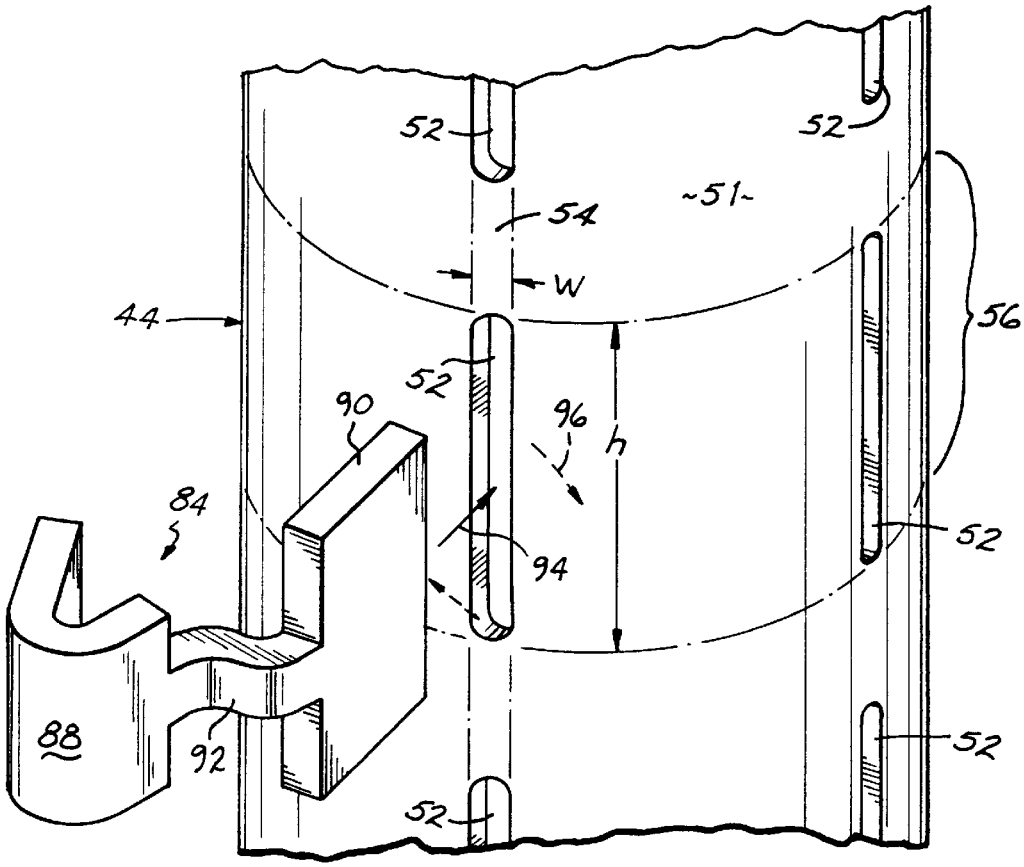
FIG. 6 is an enlarged exploded perspective view of one of the shelf supporting clips of the present invention illustrating how the clip is inserted into one of the slots of one of the hollow vertical posts.

As seen most clearly in FIG. 6, around the circumference of the walls 51 of the vertical posts 44*a–d* are aligned slots 52 extending through the thickness of the vertical posts walls. Each vertical post 44*a–d* has a plurality of vertically extending columns 54 of slots 52 and transversely extending rows 56 of slots 52 so that each of the slots 52 within a particular row 56 is at approximately the same vertical height, thus ensuring that the shelving will maintain a horizontal orientation when supported at least in part by the vertical posts. Each slot 52 has a height h and a width w.

The vertical posts 44*a–d* are connected to the end portions of the arms of the upper and lower bases with a plurality of hubs. Referring to FIG. 2, a first set of four hubs (only three of which, 58*a*, 58*b* and 58*c*, are illustrated) secure the end portions 22*a–d* of the arms 18*a–d* of the lower base 14 to the vertical posts 44*a*–44*d*. Similarly, a second set of four additional hubs 58*a*'–58*d*' secure the end portions 40*a*–40*d* of the arms 38*a–d* of the upper base 34 to the vertical posts 44*a*–44*d*. Each of the hubs are identically configured and may be made from the same mold or machined using minimal fixtures. For purposes of simplification, applicant will refer to the first set of hubs used to connect the end portions of the arms of the lower base to the vertical posts as "lower hubs" and will use the term "upper hubs" for the second set of hubs which are used to connect the outer end portions of the arms of the upper base to the vertical posts.

As best illustrated in FIGS. 4 and 5, one embodiment of hub 58 is generally clover-shaped having four quarter sections 60*a*–60*d* extending outwardly from a circular central section 62. Each of the quarter sections 60*a*–60*d* is separated from the two adjacent quarter sections by a connector 64, each connector 64 extending from a top planar surface 66 of the hub to a bottom planar surface 67. As illustrated in FIG. 4, connector 64*a* is located between quarter sections 60*a* and 60*b*, and connector 64*b* is located between quarter sections 60*b* and 60*c*. Likewise, connector 64*c* is located between quarter sections 60*c* and 60*d*. Lastly, connector 64*d* is located between quarter sections 60*d* and 60*a*. Inside the central section 62 is a hole or bore 63 extending from the top planar surface 66 to the bottom planar surface 67 of the hub.

As illustrated in FIG. 9, the hole 63 through each hub may be threaded with threads 65 along a portion of the length of the hub so that the hub may receive a threaded foot 68. The threads 65 may extend the entire length of the hole 63 from the top planar surface 66 to the bottom planar surface 67 or may extend only partially along the length of the hub. The foot 68 has a base portion 69 and a threaded stem 70 extending upwardly from the base portion 69. Each lower hub secured to a lower base may have a foot 68 with a stem 70 threadably engaged with the hole 63 of the lower hub so as to adjust the height of the lower hub. Thus, by utilizing one or more feet 68 threadably engaged with the lower hubs, the lower bases of the display stand modules may maintain a generally horizontal orientation even if supported on an uneven floor or supporting surface 30.

Each of the hub connectors 64 is sized both in depth and width so as to receive in a friction fit manner at least one finger of an end portion of one of the base arms. In order to connect a hub 58 to an end portion of one of the arms of one of the lower bases, the middle finger 32*c* is engaged with the connector by drawing the arm in the direction of arrow 72 (see FIG. 4) until the middle finger 32*c* is snugly within the recess or connector 64*a* as best illustrated in FIGS. 4 and 5. The other fingers of the end portions of each arm do not fit within the connector, but rather stabilize the engagement of the end portion of the arm with the hub (see FIG. 5). Once the middle finger and hub are so engaged in this position, one of the vertical posts 44*a–d* may be moved in the direction of arrows 80 over a portion of the hub and at least one finger of one of the base arms. With the vertical post surrounding a portion of the hub and the at least one finger inside one of the connectors, the base may not separate or pull away from the hub because at least one finger is located and locked inside the vertical post.

As best illustrated in FIG. 4, each hub 58 has a first larger diameter portion 74 and a second lesser diameter portion 76. The diameter of the second portion 76 is approximately equal to the inner diameter $d_1$ of the vertical post 44*c* (see FIG. 4) so that the vertical post 44*c* may be placed over the second portion 76 of the hub and rest on a horizontal upper lip or shoulder 78 of the first portion 74 of the hub. By moving the hollow vertical post 44*c* downwardly in the direction of arrows 80, the hollow vertical post 44*c* may fit over the second portion of the hub and the middle finger 32*c* of the end portion 22*c* of arm 18*c* of the lower base. Thus the hub 58*c* aids in supporting the vertical post 44*c* in a vertical orientation.

In order to create one of the display stand modules of the present invention, a lower base 14 may be supported on a supporting surface 30 as illustrated in FIG. 3. with the middle fingers 32*a–d* of the end portions 22*a–d* of arms 18*a*–18*d* extending upwardly a distance $d_2$ above a plane $P_1$ defined by the top walls 24*a–d* of the arms 18*a*–18*d* of the lower base. A first set of hubs (only lower hubs 58*a*–58*c* being illustrated in FIG. 2) are engaged with the arms 18*a–d* of the lower base 14 so that each arm 18*a*–18*d* has a lower hub 58*a–d*, respectively, secured to the end portion of the arm. A first or lower end 45*a–d* of each vertical post 44*a–d*, respectively, is placed over the second portion 76 of each lower hub 58*a–d* engaged with an arm of the lower base so that the middle finger 32 of each end portion 22 of each arm 18 is located inside the lower end of each post, thus providing stability and support for maintaining the hollow vertical post in vertical orientation.

Thereafter an upper base 34 identically configured to the lower base 14 having a plurality of arms 38*a*–38*d* extending outwardly from a central portion 36 of the upper base is positioned over the posts. The middle finger of the end portion 40*a–d* of each arm 38*a–d* is then inserted into one of the connectors of an upper hub 58*a'–d'*, respectively. As can be seen from FIG. 2, the middle finger of the end portion 40*a* is inserted into one of the connectors of upper hub 58*a*' in order to secure the upper hub 58*a*' to the arm 38*a* of the upper base 34. The same is true for each of the upper hubs 58*a', b',c*' and *d*'. The next step in assembling a display stand module of the present invention is to place a portion of each of the upper hubs 58*a', b',c*' and *d*' (with the middle finger of one of the arms of the upper base in one of the connectors) inside a second or upper end 47*a–d* of each one of the vertical posts 44*a*–44*d*, respectively, so that the downwardly turned middle fingers of each of the end portions of the arms are located inside the hollow interior of the vertical posts. This may be accomplished by moving the upper base 34 with set of upper hubs 58*a'–d*' attached in the direction of arrows 82 (see FIG. 2).

Another method of creating a display stand module for use in a display stand assembly of the present invention is to first secure the lower hubs 58*a–d* to the lower ends of the vertical posts 44*a–d* with a friction fit connection or any other type of connection. Upper hubs 58*a'–d*' are similarly secured to the upper ends of the vertical posts 44*a–d* by moving these hubs downwardly in the direction of arrows 49. Once the hubs are secured to each of the vertical posts, the upper and lower bases are joined to the vertical posts by inserting the fingers of the outer end portions of the arms of the upper and lower bases inside the connectors of the hubs (which are already secured partially within the vertical posts). Because the fingers of the outer end portions of the upper and lower bases extend downwardly inside the interior of the hollow vertical posts, the upper and lower bases may not move laterally with respect to the vertical posts, and the module may be disassembled only by lifting the upper and lower bases vertically in order to remove the fingers from the connectors of the hubs.

Figure 7:
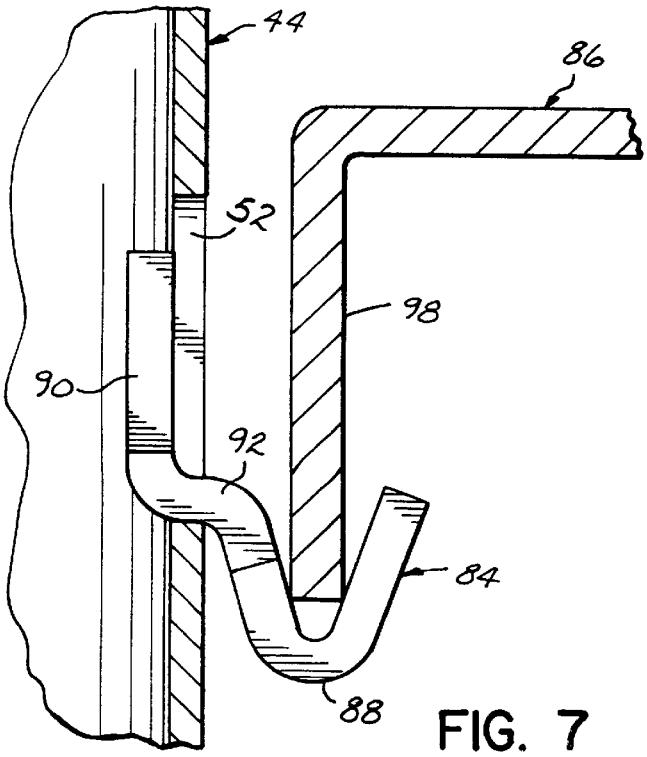
FIG. 7 is a partial cross-sectional view of one of the clips secured in one of the slots of a vertical post and supporting a shelf.

Turning now to FIG. 6, once the display stand module is assembled a plurality of clips 84 may be engaged with the slots 52 formed in the vertical posts 44*a–d* so as to support shelves 86*a,b* extending between the vertical posts. Each clip 84 has an arcuate supporting portion 88, a planar generally rectangular holding portion 90 and a connecting portion 92 connecting the holding portion 90 and the supporting portion 88. In order to secure the clip 84 in a locked position in which the clip may support shelving, the holding portion 90 must be passed in the direction of arrow 94 (see FIG. 6) through the slot 52 so that the entire holding portion 90 is inside the hollow interior of the vertical post. Then the clip 84 is rotated 90° as indicated by arrow 96 so that the holding portion 90 is locked inside the hollow interior of the vertical post and may not pass outwardly through the slot 52. Once each of the clips is rotated into a locked position, as illustrated in FIG. 7, a shelf 86*a* or 86*b* may be placed on the arcuate supporting section 88 of the clips and supported thereby. Each of the shelves 86*a* has four vertically oriented side walls 98 extending downwardly from a generally planar top portion 99. The side walls 98 are supported by the supporting portions 88 of the clips 84 in order to support the shelf in a generally horizontal orientation. As best illustrated in FIG. 2, alternatively, the shelves may be constructed of wire rather than sheet metal and may lack downwardly turned side walls (see shelves 86*b* of FIG. 2). The shelves 86*b* may have one or more outermost wire(s) 100 which may fit within the generally U-shaped supporting portion 88 of the clips in order to support the shelf 86*b*.

Referring back to FIG. 1, a display stand assembly 10 may be assembled by joining a first display stand module 12*a* to a second display stand module 12*b*. Once assembled the display stand modules are interconnected and form a unitary structure. Although only two display stand modules are illustrated in FIG. 1 interconnected to one another, any number of display stand module may be interconnected to form a display stand assembly in any number of configurations (see FIG. 8).

Still referring to FIG. 1, the first display stand module 12*a* comprises an upper base 102 and a lower base 104. The lower base 104 has a plurality of arms 106*a–d* extending outwardly from a central portion 108 of the lower base, each arm 106*a–d* terminating in an end portion 110*a–d* (only end portion 110*a* being shown). Similarly, the upper base 102 has a plurality of arms 112*a–d*, each extending outwardly from a central portion 113 and terminating in an end portion 114*a–d*. The end portions of the arms of the lower and upper bases are configured as described hereinabove with each end portion comprising multiple fingers including a middle finger adapted to engage one of the connectors of the hubs of the present invention. Four vertical posts 116*a–d* extend between the end portions of the arms of the upper and lower bases of the first display stand module. As described hereinabove, upper hubs 118*a–d* connect the vertical posts 116*a–d* to the end portions 114*a–d* of the arms 112*a–d* of the upper base. More specifically, referring to FIG. 1, upper hub 118*a* connects the end portion 114*a* of arm 112*a* of the upper base 102 to the upper end of vertical post 116*a*. Upper hub 118*b* connects the end portion 114*b* of arm 112*b* of the upper base 102 to the upper end of vertical post 116*b*. Similarly, upper hub 118*c* connects the end portion 114*c* of arm 112*c* of the upper base to the upper end of vertical post 116*c*.

Lastly, upper hub 118*d* connects the end portion 114*d* of arm 112*d* of the upper base 102 to the upper end of the vertical post 116*d*. Similarly, the end portions 110*a–d* of the arms 106*a–d* of the lower base 104 are connected to the vertical posts 116*a–d* with a set of lower hubs 120*a–d*. Lower hub 120*a* connects the end portion 110*a* of arm 106*a* of the lower base 104 to the lower end of vertical post 116*a*. In the same manner the end portions 110*b–d* of the arms 106*b–d* are connected to hubs 120*b,c,d*, respectively (only hubs 120*a* and 120*d* can be seen in FIG. 1).

Still referring to FIG. 1, a second display stand module 12*b* comprises a lower base 124 having four arms 126*a–d* extending outwardly from a central portion 127, each arm terminating in an end portion 128*a–d*, respectively. Likewise, the second display stand module 12*b* has an upper base 130 having a central portion 131 and a plurality of arms 132*a–d* extending outwardly from the central portion, each arm terminating in an end portion 134*a–d*, respectively. Additional hollow vertical post 136 extends between the end portion 134*c* of the arm 132*c* of the upper base 130 and end portion 128*c* of arms 126*c* of the lower base 124 of the second display stand module. Likewise, additional hollow vertical post 137 extends between the end portion 134*c* of arm 132*d* of the upper base 130 and end portion 128*d* of arm 126*d* of the lower base 124 of the second display stand module. Also comprising part of the second display stand module 12*b* are common vertical posts 116*c* and 116*d*. These vertical posts 116*c*, 116*d* are common to both the first and second modules and hence referred to as common posts. Vertical post 116*c* extends between hub 118*c* and hub 120*c*. Likewise, vertical post 116*d* extends between hub 118*d* and hub 120*d*, the second portions of hubs 118*d* and 120*d* being located inside the hollow vertical post 116*d*. More specifically, the second portion of hub 118*d* is located inside the upper end of hollow vertical post 116*d* and the second portion of hub 120*d* extends into the lower end of hollow vertical post 116*d*.

A pair of arms 126*a*, 126*b* of the lower base 124 of the second display stand module 12*b* are engaged with common lower hubs 120*d*,120*c*, respectively. These common lower hubs 120*d*,120*c* are also secured to the arms 106*d*, 106*c*, respectively, of the lower base 104 of the first display stand module 12*a*. Additionally, a pair of arms 132*a*,132*b* of the upper base 130 of the second display stand module 12*b* are engaged with common upper hubs 118*d*, 118*c* which are secured to the arms 112*d*, 112*c*, respectively, of the upper base 102 of the first display stand module 12*a*. More particularly, the engagement of a pair of arms 106*c*, 106*d* of the lower base 104 of the first display stand module 12*a* and the engagement of a pair of arms 126*a*, 126*b* of the lower base 124 of the second display stand module 12*b* to a common pair of hubs 120*d*, 120*c* secure a pair of adjacent lower bases 104, 124 to each other. Additionally, a pair of arms 112*c*, 112*d* of the upper base 102 of the first display stand module 12*a* and a pair of arms 132*b*, 132*a* of the upper base 130 of the second display stand module 12*b* being engaged with a pair of upper common hubs 118*c*, 118*d* secure the upper bases 102, 130 to each other. Upper common hubs 118*c*, 118*d* and lower common hubs 120*c*, 120*d* each have two of their four connectors engaged with an end portion of an arm, and more particularly, with a finger of an end portion of one of the arms of one of the bases. The two other lower hubs 138*c*, 138*d* and two other upper hubs 140*c*, 140*d* of the second display stand module 12*b* each have only one of their four connectors filled with a finger of an end portion of an arm in order to connect the hub to one of the bases 124, 130 of the second display stand module 12*b*.

As seen in FIG. 1, each of the vertical posts 116*a–d*, 136, 137 has a plurality of vertically spaced slots 52 to receive clips (not shown in FIG. 1) for supporting shelves 142 and 143. The shelf 142 extends between the vertical posts 116*a–d* of the first display stand module 12*b* and the shelf 143 extends between the posts 116*c*, 116*d*, 136 and 137 of the second display stand module 12*b*. Any number of shelves spaced at any desired intervals may be used in accordance with the present invention. The shelves may be solid as shown in FIGS. 1 and 2 or made of a wire grid construction like those illustrated in FIG. 2 or any other configuration.

Although FIG. 1 shows only a pair of arms being secured to a common hub to connect multiple modules, up to four different arms of four different bases may be connected to a common hub in order to join up to four modules together.

In order to assemble the display stand assembly 10 from a limited number of parts, a first lower base 104 of the first display stand module 12*a* and second lower base 124 of the second display stand module 12*b* are placed on a supporting surface 30. One of the arms 106*c* of the first lower base 104 and one of the arms 126*b* of the second lower base 124 are secured to a first common hub 120*c*, and likewise, a different arm 106*d* of the first lower base 104 and a different arm 126*a* of the second lower base 124 are secured to a second common hub 120*d*. Additional hubs are attached to any remaining arms 106*a*,106*b* of the first lower base 104 and any remaining arms 126*c*, 126*d* of the second lower base 124. A lower end of a hollow vertical post 116*a–d*, 136 and 137 is placed over a portion of each of the hubs 120*a–d*,138*c* and 138*d* secured to the lower bases so that the hollow vertical posts are vertically oriented. A first and second upper base 102, 130, respectively, are then provided and are supported above the supporting surface. One of the arms 112*c* of the first upper base 102 and one of the arms 132*b* of the second upper base 130 are secured to a third common hub 118*c*. Likewise, one of the arms 112*d* of the first upper base 102 and one of the arms 132*a* of the second upper base 130 are attached to a fourth common hub 118*d*. Additional hubs 118*a*, 118*b*, 140*c*, 140*d* are attached at the remaining arms of the first and second upper bases. Lastly a portion of each of the hubs attached to the arms of the first and second upper bases, while engaged or secured to the outer end portions of the arms, are placed inside the upper ends of the hollow vertical posts in order to complete the assembly. In this manner any different number of modules may be joined together in order to create a unique display stand assembly. Using this method of assembling a display stand assembly from a limited number of parts, a unique display stand assembly adapted to fit a particular environment may be quickly and easily assembled.

Another method of assembling the display stand assembly 10 of the present invention involves first connecting the hubs of the display stand modules to the vertical posts using any number of types of connections including a press-fit connection. Once hubs are secured to the ends of the hollow vertical posts, the upper and lower bases of the display stand modules are joined to the vertical posts by inserting the fingers at the outer end portions of the arms of the upper and lower bases inside the connectors of the upper and lower hubs which are secured to the posts. The common hubs receive more than one finger of more than one arm of multiple bases.

FIG. 8 illustrates a display stand assembly utilizing six different display stand modules 12*a–f* interconnected together using the method described hereinabove and the parts described hereinabove. Although the configuration of display stand modules illustrated in FIG. 8 represents a generally triangle-shaped configuration of six modules, the display stand module of the present invention may be connected to other display stand modules to form a unique configuration of display stand assembly adapted to fit into any particular location.

In accordance with the present invention, display stand modules may be placed on top of one another as well as beside one another in order to create a display stand assembly.

Figure 10:
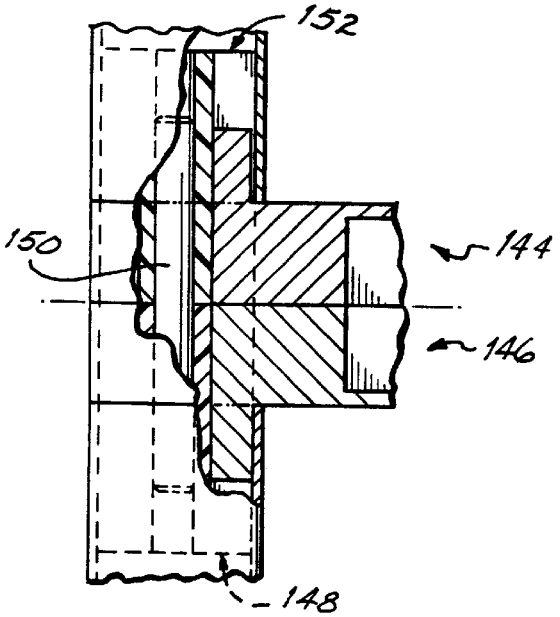
FIG. 10 is a partially broken away cross-sectional view of one upper hub of one module secured to one lower hub of another module with a securing rod extending between and connecting the two hubs.
Figure 12:
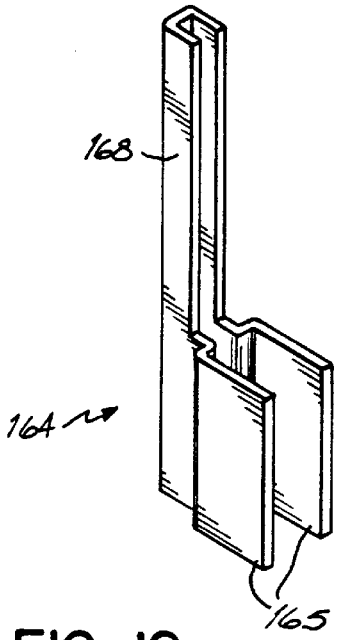
FIG. 12 is a perspective view of an end piece used to manufacture the base of FIG. 11.

Referring to FIG. 10, in order to secure one display stand module 144 on top of another display stand module 146, the upper hubs 148 connected to the arms of the upper base of the display stand module 144 are exposed. A securing rod 150 is placed inside the centrally located hole or bore of each of these upper hubs 148, the securing rod 150 extending upwardly above the upper base of the module 146. A lower hub 152 of the display stand module 144 is then placed over the top of the upper hub 148 of the display stand module 144 with the securing rod 150 being located inside the holes of the upper and lower hubs 148, 152, respectively. Thus the securing rod 150 extends partially through the holes of the hubs 148, 152 which are located on top of one another, thereby securing them together so that they do not move laterally relative to one another. In this manner all four upper hubs 148 of a display stand module 146 are secured to all four lower hubs 152 of display stand module 144 in order to connect the modules on top of one another.

Figure 11:
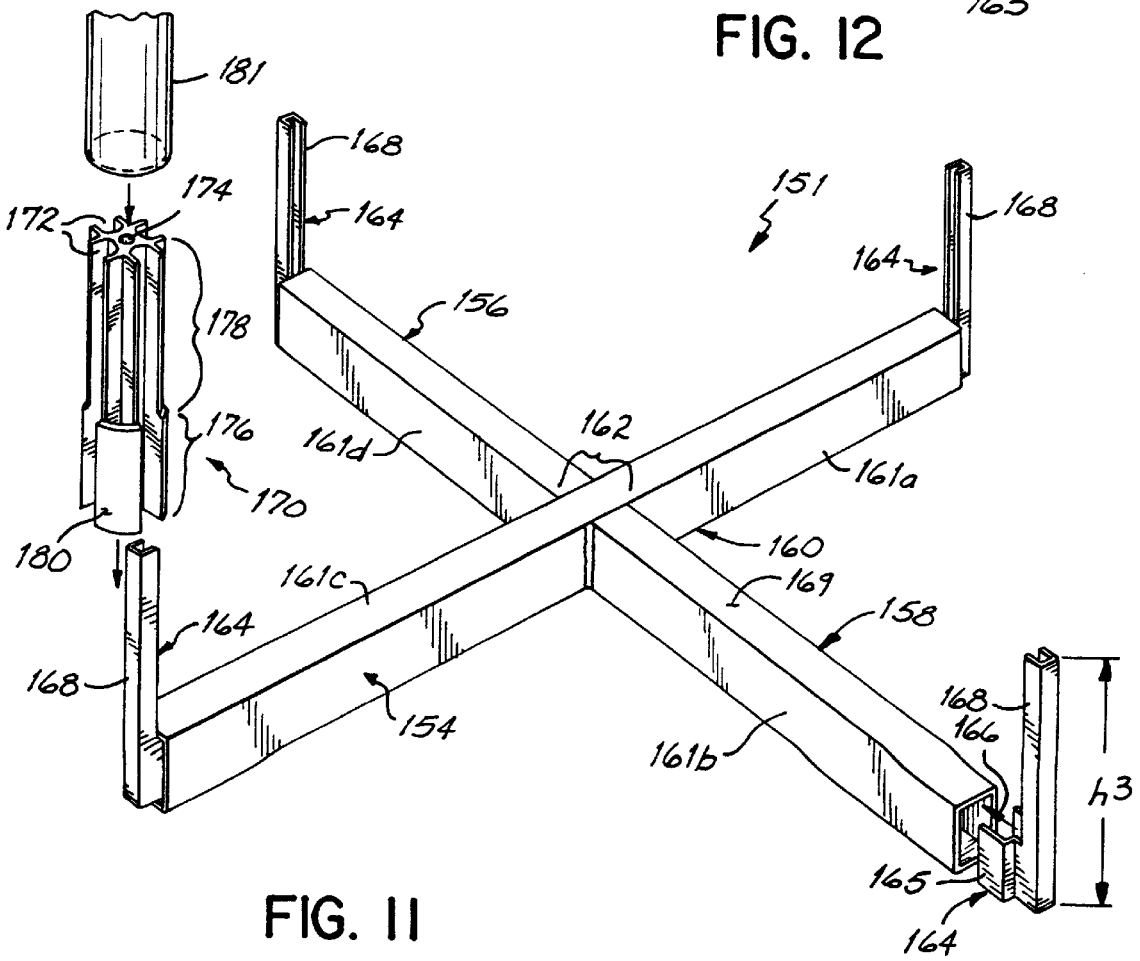
FIG. 11 is an exploded perspective view of a portion of a second embodiment of a module incorporating a second embodiment of base, a second embodiment of hub and a vertical post.

FIG. 11 illustrates an alternative or second embodiment of base 151 and hubs 170 for creating the modular display stands of the present invention. This embodiment of base is preferably made from sheet metal and comprises a first member 154 welded to second and third members 156 and 158 in order to create an X-shaped subbase 160 having four arms 161*a–d* extending outwardly from a central portion 162. The second and third members 156, 158 are secured orthogonally to the first member 154 by welds. However, other securement means such as slotted interconnections may be used as well. At the outer end of each arm 161 *a–d*, a formed sheet metal end piece 164 is welded or otherwise secured to the subbase 160 by moving the fins 165 of each end piece 164 in the direction of arrow 166 into the hollow interiors of the arms and welding them therein. Each end piece 164 has a finger 168 extending upwardly a significant distance above the fins 165 as well as above the upper surface 169 of the subbase 160. The height $h^3$ of the finger 168 is approximately equal to the height of a hub 170.

The hubs 170 are generally similar to the hubs 58 described hereinabove. Each hub 170 has four connectors 172 adapted to receive and engage the fingers 168 of the base 151. Each hub 170 further has a centrally located threaded hole or bore 174 therethrough and a first large diameter portion 176 and a second smaller diameter portion 178. An outer wall 180 extends between the connectors 172 of the hub. The outer wall 180, however, does not extend for the full height of the hub 170 as it does in the hubs 58 of the first embodiment described hereinabove. The second portion 178 of the hub is sized and adapted to fit inside the hollow interior of one of the vertical posts 181.

Although a detailed description of a several preferred embodiments of the present invention have been described above, it will be readily appreciated by those of ordinary skill in the art that many modifications may be made to the present invention without departing from the spirit and scope of the present invention. It is therefore applicant's intention to be bound only by the scope of the following claims and not to the detailed specifics provided in the specification above.

We claim:

1. A display stand module adapted to be joined to other display stand modules to create a display stand assembly, said display stand module comprising:

a lower base having a central portion and a plurality of arms extending outwardly from said central portion, each of said arms of said lower base terminating in an end portion having a finger projecting upwardly from said end portion, an upper base having a central portion and a plurality of arms extending outwardly from said central portion of said upper base, each arm of said upper base terminating in an end portion having a finger projecting downwardly from said end portion, vertical posts extending between said end portions of said arms of said upper and lower bases, each of said vertical posts having a pair of opposed ends and a hollow interior, and a plurality of hubs connecting said vertical posts to said end portions of said arms of said upper and lower bases, each of said hubs having a portion adapted to fit inside said hollow interior of one of said vertical posts and a plurality of connectors, one of said connectors receiving one of said fingers of one of said end portions of one of said arms of one of said bases, wherein each end of each of said vertical posts surrounds said portion of said hub adapted to fit inside said hollow interior of said vertical post and at least one of said fingers of at least one of said end portions of at least one of said bases.

2. The display stand module of claim 1 wherein said upper and lower bases are identically configured.

3. The display stand module of claim 1 wherein each of said hubs has a centrally located hole adapted to receive a rod for securing multiple hubs to each other.

4. The display stand module of claim 1 further comprising shelves extending between said vertical posts.

5. The display stand module of claim 1 wherein each vertical post has vertically spaced slots adapted to receive clips for supporting shelving.

6. A display stand module adapted to be joined to other display stand modules to create a display stand assembly, said display stand module comprising:

a lower base having a central portion and a plurality of arms extending outwardly from said central portion, each arm of said lower base terminating in an end portion having at least one finger projecting above said arm, an upper base having a central portion and a plurality of arms extending outwardly from said central portion of said upper base, said upper base being spaced above said lower base, each arm of said upper base terminating in an end portion having at least one finger projecting below said arm of said upper base, hollow posts extending between said end portions of said arms of said lower and upper bases, and hubs connecting said hollow posts to said end portions of said arms of said lower and upper bases, each hub having a portion adapted to fit inside one of said hollow posts and having a plurality of connectors, one of said connectors receiving one of said fingers of one of said end portions of one of said arms of one of said bases, each of the other connectors of said hub being adapted to receive a finger of an arm of an additional base of an additional display stand module, wherein each of said hollow posts surrounds at least one of said fingers of said upper base and at least one of said fingers of said lower base.

7. The display stand module of claim 6 further comprising shelves extending between said hollow posts.

8. The display stand module of claim 6 wherein each hollow post has vertically spaced slots adapted to receive clips for supporting shelving.

9. The display stand module of claim 6 wherein said upper and lower bases are identically configured, said upper base being inverted relative to said lower base.

10. The display stand module of claim 6 wherein each base has four arms.

11. A display stand module adapted to be joined to other display stand modules to create a display stand assembly, said display stand module comprising:

an upper base and a lower base, each of said bases having a plurality of arms extending outwardly from a central portion, each arm terminating in an end portion having a finger of a fixed height, a plurality of identically configured hubs, each of said hubs having a height equivalent to said fixed height, a first portion, a second portion and a plurality of connectors, one of said connectors receiving one of said fingers, and a plurality of hollow posts, each of said hollow posts connecting an upper hub and a lower hub, wherein each of said hollow posts surrounds one of said portions of one of said hubs and one of said fingers.

12. The display stand module of claim 11 wherein said posts are slotted so as to receive a plurality of clips, said clips being adapted to support shelving.

13. The display stand module of claim 11 further comprising a plurality of shelves extending between said posts.

14. A method of creating a display stand module for use in a display stand assembly comprising the steps of:

providing a lower base having a plurality of arms extending outwardly from a central portion, each arm terminating in an end portion having a finger projecting upwardly from said end portion, securing a lower hub to the end portion of each arm of said lower base, placing a first end of a hollow post over a portion of each of said lower hubs and one of said fingers in order to support said hollow post in a vertical orientation, providing an upper base having a plurality of arms extending outwardly from a central portion of said upper base, each arm of said upper base terminating in an end portion having a finger projecting downwardly from said end portion of said arm of said upper base, securing an upper hub to the end portion of each arm of said upper base, and placing a portion of each upper hub and one of said fingers of said upper base inside a second end of one of the hollow posts in order to complete the display stand module.

15. The method of creating a display stand module of claim 14 further comprising the step of securing a plurality of shelves to said hollow posts.

16. A method of creating a display stand module for use in a display stand assembly, said display stand module comprising a plurality of upper and lower hubs, a plurality of vertical posts, an upper base and a lower base, each base having a plurality of arms extending outwardly from a central portion of said base, each arm terminating in an end portion having a vertically oriented finger, said method comprising the steps of:

securing one of said upper hubs and one of said lower hubs to opposite ends of each of said vertical posts, placing said lower base on a supporting surface such that said vertically oriented fingers of said lower base project above said arms of said lower base, securing said vertically oriented fingers of said lower base to the lower hubs secured to said vertical posts, and securing said vertically oriented fingers of said upper base to the upper hubs secured to said vertical posts such that said vertical posts surround said fingers of said upper and lower bases.

17. The method of assembling a display stand module of claim 16 further comprising the step of securing a plurality of shelves to said vertical posts.

18. A display stand assembly comprising a plurality of interconnected display stand modules, said display stand assembly comprising:

a first display stand module comprising an upper base and a lower base, each base having a central portion and a plurality of arms extending outwardly from said central portion, each arm of said upper and lower bases terminating in an end portion having a vertically oriented finger projecting from said end portion, hollow vertical posts extending between said end portions of said arms of said upper and lower bases of said first display stand module, hubs connecting said hollow vertical posts to said end portions of said arms, each of said hubs having a plurality of connectors, one of said connectors receiving one of said vertically oriented fingers of one of said arms of one of said bases, a second display stand module comprising an upper base and a lower base, each base of said second display stand module having a central portion and a plurality of arms extending outwardly from said central portion, each of said arms terminating in an end portion having a vertically oriented finger projecting from said end portion, and at least one additional hollow vertical post, each additional hollow vertical post extending between the end portion of one of the arms of said upper base of said second display stand module and the end portion of one of the arms of the lower base of said second display stand module, each of said additional hollow vertical posts being connected to said upper and lower bases of said second display stand module with additional hubs, wherein select arms of said upper and lower bases of said second display stand module are secured to select hubs of said first display stand module in order to connect said first and second display stand modules and each of said hollow vertical posts surrounds a portion of one of said hubs and at least one of said vertically oriented fingers of at least one of said bases.

19. The display stand assembly of claim 18 further comprising shelves extending between said hollow vertical posts.

20. The display stand assembly of claim 18 wherein each of said hollow vertical posts has vertically spaced slots adapted to receive clips for supporting shelving.

21. A display stand assembly comprising:

a plurality of display stand modules, each display stand module comprising an upper base, a lower base and a plurality of hollow vertical posts, each of said bases having a central portion and a plurality of arms extending outwardly from said central portion, each of said arms terminating in an end portion having at least one finger projecting from said end portion, said hollow vertical posts extending between said end portions of said arms of said upper and lower bases, said hollow vertical posts being secured to said end portions of said arms with upper and lower hubs adapted to fit partially within said vertical posts, said upper and lower hubs having a plurality of connectors adapted to receive the end portions of the arms of said bases, wherein an upper end of each of said hollow vertical posts surrounds a portion of one of said upper hubs and at least one of said fingers and a lower end of each of said hollow vertical posts surrounds a portion of one of said lower hubs and at least one of said fingers.

22. The display stand assembly of claim 21 further comprising shelves extending between said hollow vertical posts.

23. A method of assembling a display stand assembly from several display stand modules comprising the steps of:

providing at least two lower bases and at least two upper bases, each base having a plurality of arms extending outwardly from a central portion, each arm having an outer end portion with at least one finger, supporting said lower bases on a supporting surface so that each finger of each of said lower bases projects above said arms of said lower base, providing a plurality of hubs, each hub having a plurality of connectors, each connector being adapted to receive at least one of said fingers, providing a plurality of hollow vertical posts, each vertical post having a first end and a second end, securing one of said hubs to each end of each of said hollow vertical posts, inserting said at least one finger of each arm of each lower base into one of the connectors of one of the hubs secured to said first ends of said vertical posts in order to support said vertical posts in a vertical orientation and join said vertical posts to said lower bases, select hubs receiving multiple fingers of multiple arms in order to join adjacent lower bases, orienting said upper bases so that said fingers of said arms of said upper bases project below said arms of said upper bases, and securing said at least one finger of each arm of each of said upper bases to one of the hubs secured to said second ends of said vertical posts such that said ends of said vertical posts surround said fingers of said arms of said upper and lower bases.

24. The method of claim 23 further comprising locking clips at preselected vertical heights on said vertical posts, and supporting at least one shelf with said clips.

25. The method of claim 24 wherein locking said clips comprises inserting a portion of each clip into a slot in one of said posts and rotating said clip.

26. A method of making a display stand assembly from several display stand modules comprising:

supporting a first lower base and a second lower base on a supporting surface, each lower base having a plurality of arms extending outwardly from a central portion and terminating in at least one finger, attaching one of said arms of said first lower base and one of said arms of said second lower base to a first common hub, attaching one of said arms of said first lower base and one of said arms of said second lower base to a second common hub, attaching additional hubs to any remaining arms of said first and second lower bases, placing a lower end of a hollow vertical post over a portion of each of said hubs and at least one of said fingers so that said hollow vertical posts are vertically oriented, providing a first upper base and a second upper base, said first and seconds upper bases being supported above said supporting surface, each upper base having a plurality of arms extending outwardly from a central portion of the upper base and terminating in at least one finger, attaching one of the arms of the first upper base and one of the arms of the second upper base to a third common hub, attaching one of the arms of the first upper base and one of the arms of the second upper base to a fourth common hub, attaching additional hubs to any remaining arms of said first and second upper bases, and placing a portion of each of the hubs attached to the arms of the first and second upper bases and at least one of said fingers inside upper ends of the hollow vertical posts.

27. The method of claim 26 further comprising locking clips in slots formed in said hollow posts at preselected vertical heights on said posts, and supporting shelves with said clips.

28. The method of claim 27 wherein locking said clips comprises inserting a portion of each clip into one of said slots in said hollow posts and rotating said clip.

* * * * *

UNITED STATES PATENT AND TRADEMARK OFFICE

CERTIFICATE OF CORRECTION

PATENT NO. : 6,036, 034
DATED : March 14, 2000
INVENTOR(S) : Joseph M. Battaglia and Rafael T. Bustos It is certified that error appears in the above-identified patent and that said Letters Patent is hereby corrected as shown below:

In column 8, line 47, "FIG. 3. with" should read —FIG. 3, with—.

In column 10, line 3, "module" should read as —modules—.

In column 13, line 23, "description of a several" should read as —description of several—.

In column 18, line 6, "first and seconds upper" should read as —first and second upper—.

Signed and Sealed this

Fifth Day of June, 2001

*Attest:*

*Attesting Officer*

Nicholas P. Godici

NICHOLAS P. GODICI

*Acting Director of the United States Patent and Trademark Office*